United States Patent [19]

Sawaguchi et al.

[11] Patent Number: 4,986,182

[45] Date of Patent: Jan. 22, 1991

[54] CLEANING APPARATUS AND CLEANING METHOD OF BLANKET OF PRINTING PRESS

[75] Inventors: Ikuo Sawaguchi; Kiyonobu Omi, both of Saitama, Japan

[73] Assignee: Nikka Kabushiki Kaisha, Tokyo, Japan

[21] Appl. No.: 276,398

[22] Filed: Nov. 25, 1988

[30] Foreign Application Priority Data

Sep. 13, 1988 [JP] Japan ..... 63-229459

[51] Int. Cl.[5] ..... B41F 35/06; B41L 41/06

[52] U.S. Cl. ..... 101/483; 101/425; 101/423; 15/256.51

[58] Field of Search ..... 101/425, 424, 423, 483; 15/256.51; 355/300

[56] References Cited

U.S. PATENT DOCUMENTS 4,016,812 4/1977 Lauk et al. ..... 101/425

4,058,059 11/1977 Moestue ..... 101/425

4,389,936 6/1983 Jaffa et al. ..... 101/425

4,765,242 8/1988 Oya et al. ..... 101/425

*Primary Examiner*—Edgar S. Burr

*Assistant Examiner*—C. A. Bennett

*Attorney, Agent, or Firm*—Fleit, Jacobson, Cohn, Price, Holman & Stern

[57] ABSTRACT

A cleaning apparatus of a blanket of a printing press has a cleaning cloth, a take-up roller of the cleaning cloth, a press device for pressing the cleaning cloth to the surface of a blanket cylinder to be cleaned, and rewinding device for rewinding the used cleaning cloth from the take-up roller to the supply roll for use in the following cleaning cycle. Cleaning is carried out while the cleaning cloth is being supplied from the supply roll to the take-up roller, and part of the used cleaning cloth is rewound after this cleaning cycle is completed by rotating reversely the supply roll and is used again during part of the next cleaning cycle.

6 Claims, 3 Drawing Sheets

CLEANING APPARATUS AND CLEANING METHOD OF BLANKET OF PRINTING PRESS

BACKGROUND OF THE INVENTION

The present invention relates to a technique of cleaning automatically a blanket cylinder of a printing press by pressing a cleaning cloth to the blanket cylinder. More particularly, the present invention relates to an automatic blanket cleaning technique of a printing press which also has an automatic rewinding mechanism on the side of a supply roll of a cleaning cloth and rewinds part of the used cleaning cloth after one cleaning cycle is completed in order to use it once again during part of the next cleaning cycle.

A cleaning technique is heretofore known which has the fundamental structure wherein a cleaning cloth supplied from a supply roll is taken up by a take-up roller through a press member and is pressed to a blanket cylinder by the press member to clean the blanket cylinder.

Various structures have been developed and proposed for the press member. For example, Japanese Patent Laid-Open No. 51-56306/1976 teaches the use of a press roller while Japanese Patent Laid-Open No. 55-148164/1980 discloses the press member of the type wherein a rubber tube is inflated by air.

A non-woven fabric or the like has been used as the cleaning cloth. Generally, the non-woven fabric is supplied from a manufacturer under the state where a predetermined length of the non-woven fabric is wound on a paper bobbin. After the roll of non-woven fabric is set as a supply roll to a cleaning apparatus, the tip of the non-woven fabric is fitted to a take-up roller for use.

Cleaning is made by transferring the non-woven fabric either intermittently or continuously from the supply roll to the take-up roller and pressing the cleaning cloth to the surface of the blanket cylinder to be cleaned by the press member during this transfer process. At this time the cleaning cycle is employed wherein the cleaning cloth is dampened appropriately by a cleaning liquid such as a solvent or water to dissolve ink components or the like that adhere to the blanket cylinder and they are then wiped away by the portions of the cleaning cloth that are not dampened by the cleaning liquid. Accordingly, in accordance with the prior art technique, the cleaning cloth has been supplied always unidirectionally from the supply roll to the take-up roller.

As described above, the non-woven fabric as the cleaning cloth is generally supplied under the state where the non-woven fabric of about 10 to 12 m is wound onto one paper bobbin. About 40 cm of non-woven fabric is used in one cleaning cycle in a newspaper offset press while about 15 to about 20 cm of non-woven fabric is used in a sheet offset press and the cleaning liquid is sprayed once or several times to dampen the non-woven fabric for cleaning. The portions of the non-woven fabric dampened by the cleaning liquid are used for dissolving the ink adhering to the blanket cylinder while its dry portions are used for wiping.

Cleaning is made twice or thrice a day in the case of newspaper printing, for example. Therefore, one roll of non-woven fabric is used up within eight to ten days and must be replaced by a new one.

Since the blanket cleaning apparatus of the printing press is the one that is directed to save labor, it is desired to reduce the frequency of replacement of expendables as much as possible and to reduce the cost of operation.

SUMMARY OF THE INVENTION

The present invention is completed in view of the background of the prior art technique described above.

It is therefore an object of the present invention to provide a blanket cleaning apparatus of a printing press which minimizes the frequency of replacement of expendables, to make it easier to conduct the replacement work and to reduce the cost of operation.

Another object of the present invention is to provide a new method of cleaning the blanket cylinder of the printing press.

A further object of the present invention is to provide a new cleaning method of the blanket cylinder by using the cleaning apparatus of the present invention.

A cleaning apparatus of a blanket of a printing press according to the present invention comprises a supply roll of a cleaning cloth, a take-up roller of a cleaning cloth equipped with an automatic take-up mechanism and a press member for pressing the cleaning cloth between the supply roll and the take-up roller to the surface of a blanket cylinder to be cleaned. The supply roll and the take-up roller are supported rotatably both normally and reversely and the supply roll is equipped with an automatic rewind mechanism. The automatic rewind mechanism rewinds the cleaning cloth from the take-up roll to the supply roll.

Brake mechanisms are preferably provided to the supply roll and to the take-up roller, respectively, in order to apply back-tension thereto and a feed quantity detection mechanism of the cleaning cloth is preferably disposed between the supply roll and the take-up roller. This feed quantity detection mechanism can be composed, for example, of the combination of a rotary member rotating while making always contact with the cleaning cloth and a rotation sensor for detecting the rotation of the rotary member.

In the present invention, cleaning is carried out while the cleaning cloth is being supplied from the supply roll to the take-up roller, and part of the used cleaning cloth is rewound after this cleaning cycle is completed by rotating reversely the supply roll and is used again during part of the next cleaning cycle.

In addition to the automatic take-up mechanism provided to the take-up roller, an automatic rewinding mechanism is also provided to the supply roll in the present invention. Therefore, both the supply roll and the take-up roller are supported rotatably both normally and reversely, and it is possible to take up the cleaning cloth to the take-up roller by the take-up mechanism or to rewind it to the supply roll by the rewinding mechanism.

In a newspaper offset press, for example, about 40 cm of cleaning cloth is used during one cleaning cycle. The leading part of the cleaning cloth is dampened by the cleaning liquid and is much contaminated by large quantities of ink or the like adhering to a blanket cylinder. As the surface of the blanket cylinder becomes more and more clean, however, the trailing part of cleaning cloth is relatively less contaminated than the former half because it is used for drying the cleaning liquid adhering to the blanket cylinder.

The present invention is based upon the finding that the latter half portion (generally about $\frac{1}{3}$) of the used cleaning cloth is less contaminated. Thus, in the present invention, the latter half portion of the cleaning cloth with relatively less contamination is rewound before the next cleaning cycle and this rewound and used cleaning cloth is used again at the beginning of the next cleaning cycle. Though used, the used cleaning cloth can be reused without any problem at the beginning of the next cleaning cycle because it is relatively clean.

After one cleaning cycle is thus completed, the trailing part of the used cleaning cloth is rewound and used again at the beginning of the next cleaning cycle. Thus, the used quantity of the cleaning cloth can be saved. In other words, the frequency of necessity of replacement of cleaning cloth drops. Rewinding of the cleaning cloth is carried out by controlling an automatic rewinding mechanism according to a signal from the feed quantity detection mechanism.

After the cleaning cloth is used up, it is rewound fully to the supply roll by operating the automatic rewinding mechanism so that the used cleaning cloth can be discarded with the paper bobbin. Accordingly, the cleaning cloth can be replaced very easily by the manual operation of only removing the used cleaning cloth and mounting a new cleaning cloth without any stain or contamination.

PREFERRED EMBODIMENT OF THE INVENTION

Figure 1:
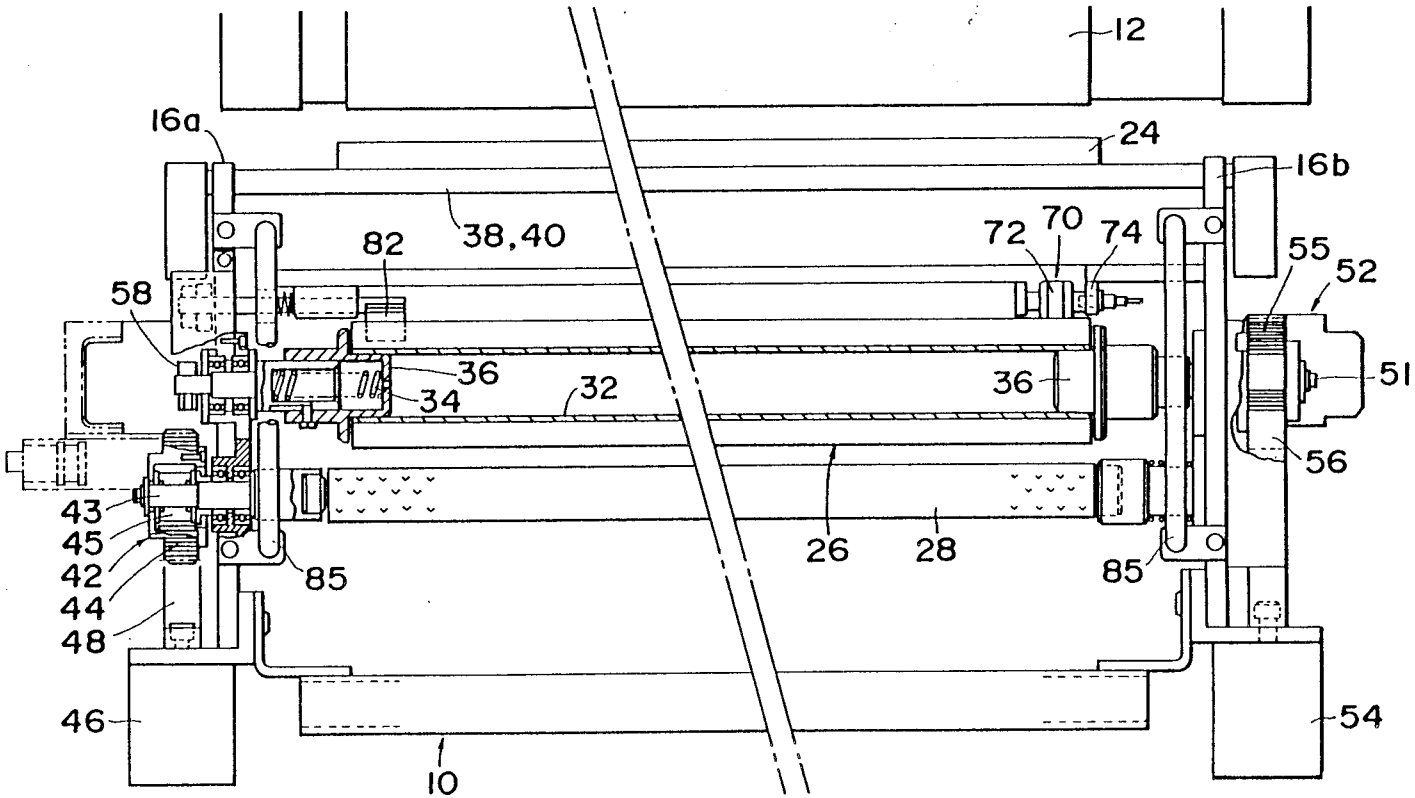
FIG. 1 is a plan view of a blanket cleaning apparatus embodying the present invention.

A cleaning apparatus main body 10 is positioned in parallel with the center axis of a blanket cylinder 12 and is supported at its both ends by fitting brackets 14*a* and 14*b*. The fitting brackets 14*a*, 14*b* are mounted to printing press frames 15*a*, 15*b*. The cleaning apparatus main body 10 has side frames 16*a*, 16*b* positioned on both sides of the main body 10 and a main frame 18 coupling them, as the principal structural members.

A press pad 24 is disposed so as to face the blanket cylinder 12 and is fitted to the tip of the main frame 18 through a pad core metal 20. A supply roll 26 and a take-up roller 28 are supported rotatably both normally and reversely between both side frames 16*a*, 16*b* and a non-woven fabric 30 for cleaning is stretched and wound between the roll 26 and roller 28. The supply roll 26 has the non-woven fabric 30 for cleaning that is wound on a paper bobbin 32 and is supported by a roll holder 36 with built-in springs 34 on both of its sides The non-woven fabric 30 for cleaning is guided from the supply roll 26 to the take-up roller 28 through the outer surface of the press pad 24. The take-up roller 28 is the one that has a large number of sharp projections on its surface. These projections hook and hold the non-woven fabric 30. A water nozzle pipe 38 and a solvent nozzle pipe 40 are disposed above the press pad 24 and are supported by the main frame 18.

The take-up roller 28 is provided with an automatic take-up mechanism 42. This automatic take-up mechanism 42 has a take-up roller shaft 43, a pinion 44 fitted to the take-up roller shaft 43 through a unidirectional cam clutch 45, a take-up air cylinder 46 mounted to the side frame 16*a*, a rack 48 coupled to the piston of the take-up air cylinder 46 and meshing with the pinion 44 and a rack guide 50 guiding the reciprocation of the rack 48. A rewinding mechanism 52 having a similar mechanism as the aforementioned automatic take-up mechanism is disposed on the supply roll 26. In other words, a rewinding air cylinder 54 is coupled to the supply roll 26 through a rack 56 and pinion 55 mechanism. The rack 56 is coupled to a shaft 51 through a unidirectional cam clutch, not shown, which is similar to the unidirectional cam shaft 45.

Brake mechanisms are provided to the supply roll 26 and to the take-up roller 28, respectively, though only one of which is illustrated. A brake mechanism which is shown at 58 on the supply roll 26 is mounted to the side frame 16*a* and the other brake mechanism (not shown), which can be similar to the brake mechanism 58, on the take-up roller 28 is mounted to the side frame 16*b*. The brake mechanisms prevent unnecessary rotation of the corresponding roll 26 and roller 28 when their rack-pinion mechanisms are cut off, and apply back-tension to the non-woven fabric 30 when it is moved.

The press pad 24 in this embodiment has a solid structure consisting of an oil-resistant rubber. This material does not have a continuous foam structure such as a sponge but has a solid (compact) structure preventing the permeation of the solvent or the like. Though not as so soft as the sponge, the press pad 24 is an integrally molded article.

Figure 4:
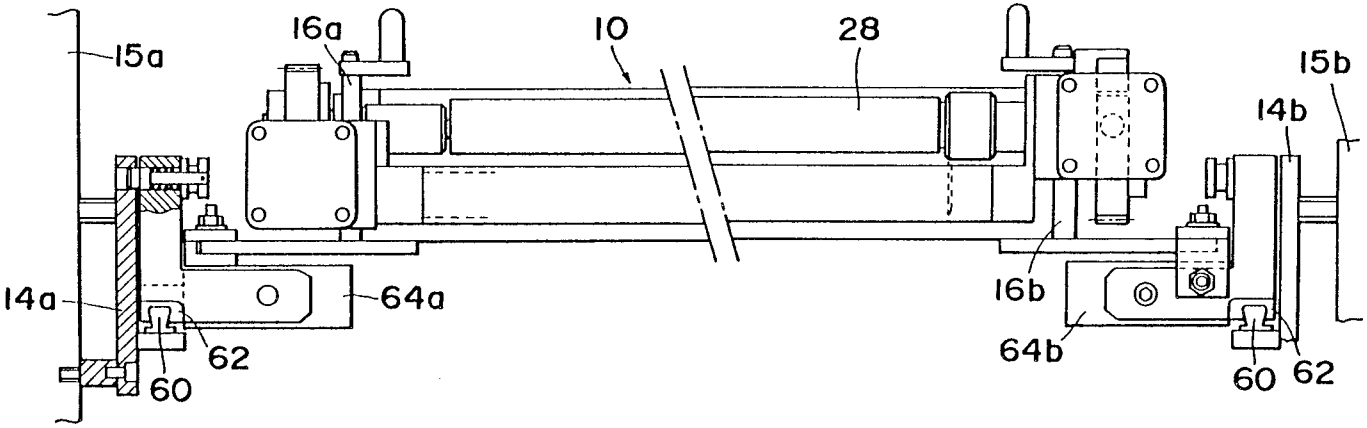
FIG. 4 is a front view of the blanket cleaning apparatus shown in FIG. 1.

In FIGS. 1 and 4, the cleaning apparatus main body 10 is supported on guides 60 of the fitting brackets 14*a*, 14*b*through linear motion bearings 62 and can move back and forth in the direction of the blanket cylinder 12. The forward and backward movement is caused by press air cylinders 64*a*, 64*b* mounted to the fitting brackets 14*a*, 14*b*, respectively.

Figure 2:
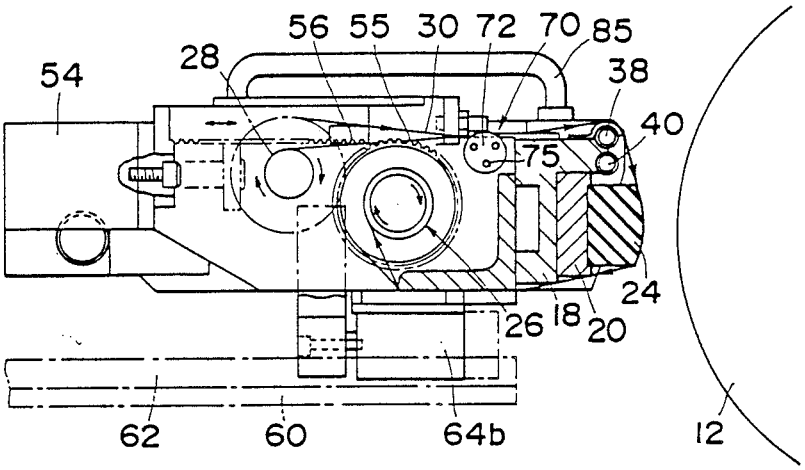
FIG. 2 is a right side view of the blanket cleaning apparatus shown in FIG. 1.

In FIGS. 1 and 2, a feed quantity detection mechanism 70 of the cleaning non-woven fabric 30 is disposed between the supply roll 26 and the take-up roller 28. This feed quantity detection mechanism 70 is equipped with a rotary member 72 which rotates while always making contact with the non-woven fabric 30 and a rotation sensor 74 for detecting the rotation of the rotary member 72. Corrugations or small projections are formed on the outer peripheral surface of the rotary member 72, suitably bite into the non-woven fabric 30 and rotate without slip. Three magnetic members 75 are embedded in the side surface of the rotary member 72 and the magnetic rotation sensor 74 is positoned in a spaced confronting relation to the magnetic members 75. Therefore, the feed quantity of the non-woven fabric 30 is converted to the rotation of the rotary member 72 and the rotation is detected by the rotation sensor 74.

Figure 3:
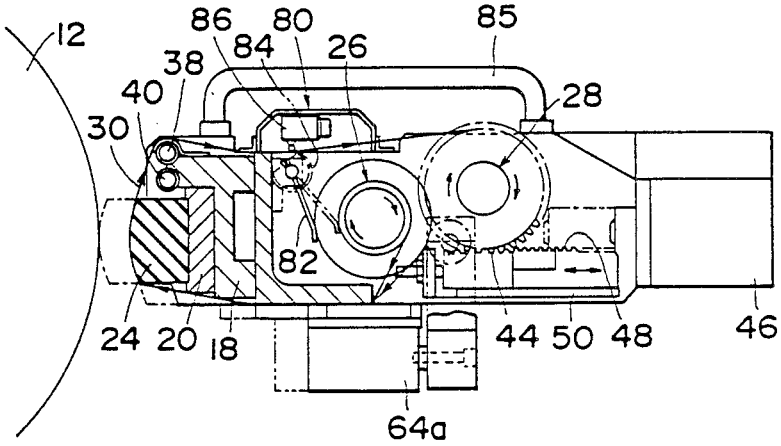
FIG. 3 is a left-side view of the blanket cleaning apparatus shown in FIG. 1.

In FIG. 3, a cloth absence detection mechanism 80 is disposed on the supply roll 26. The cloth absence mechanism 80 has a detection plate 82 pivotably urged to an outer surface of the non-woven fabric of the supply roll 26 by the force of a spring(not shown), a rotary plate 84 coupled at its base end to a rotation shaft of the detection plate, a limit switch 86 turned ON and OFF in accordance with the rotating position of the semi-circular rotary plate 84.

The blanket cylinder is cleaned in the following way. A new non-woven fabric 30 for cleaning is supplied from a manufacturer under the state where it is wound on the paper bobbin 32. The bobbin 32 is clamped and held by the roll holder 36. The non-woven fabric 30 is passed through the tip of the press pad 24 and is wound on the take-up roller 28. Since a large number of sharp projections are formed on the surface of the take-up roller 28 as described already, the non-woven fabric 30 can be firmly supported when caught by the projections and wound several times on the roller 28.

To make cleaning, the cleaning liquid is sprayed from the water spray pipe 38 and the solvent spray pipe 40 towards the non-woven fabric 30, as necessary, and while the non-woven fabric is dampened, the cleaning apparatus main body 10 is moved forth by driving the press air cylinder 64*a*, 64*b* so as to push the dampened non-woven fabric 30 to the surface of the contaminated blanket cylinder 12. In this manner the adhering ink is dissolved and paper powder and the like is removed.

Then, the cleaning apparatus main body 10 is slightly returned by the press air cylinders 64*a*, 64*b* and the non-woven fabric 30 is taken up by the automatic take-up mechanism 42. While back-tension is applied to the non-woven fabric 30 by the brake mechanism 58 on the supply roll side, the take-up air cylinder 46 is driven to rotate the take-up roller 28 through the rack pinion mechanism and the unidirectional cam clutch 45. The feed quantity of the non-woven fabric 30 is detected by the feed quantity detection mechanism 70 so as to control the operation of the automatic take-up mechanism 42. The rack 48 and the pinion 44 are cut off from each other under the state where the take-up air cylinder 46 returns to the original state. The rack 48 is supported by a leaf spring (not shown)in such a manner as to be capable of somewhat deflecting in a vertical direction so that the rack 48 moves forth toward the blanket cylinder and meshes smoothly with the pinion 44, and when the tooth of the rack strikes that of the pinion, the rack escapes slightly, moves forward and enters the engagement. On the other hand, the unidirectional cam clutch 45 is disposed in order to rotate unidirectionally the take-up roller 28 when the rack 48 meshes with the pinion 44.

Next, the cleaning apparatus main body 10 is again moved forth by the press air cylinders 64*a*, 64*b* and the new non-woven fabric 30 is pressed to the blanket cylinder 12 by the press pad 24. This operation is carried out repeatedly and cleaning is effected by supplying water and/or the solvent, as necessary. The jetting period of water or the solvent is extremely short during the cleaning cycle but is repeated several times.

During the latter half of the cleaning cycle, water and the solvent are not supplied but the non-woven fabric 30 is simply pressed to the blanket cylinder 12 and is taken up. The pressing and taking-up operations are repeated alternately to make cleaning and wiping and removal of the moisture and the like adhering to the blanket cylinder 12 to complete one cleaning cycle. The length of the cleaning non-woven fabric used during one cleaning cycle is about 40 cm in the newspaper offset press, though it varies depending on the degree of contamination. The blanket cylinder is extremely stained by the ink or the like during the former half of the cleaning cycle but as cleaning proceeds, it is relatively clean during the latter half.

In accordance with the present invention, the automatic rewinding mechanism 52 is operated after one cleaning cycle is completed, in order to rewind part of the used non-woven fabric to the supply roll 26. This rewind quantity is controlled according to the signal detected by the feed quantity detection mechanism 70. Experiments reveal that about trailing $\frac{1}{3}$ of the non-woven fabric used in one cleaning cycle is relatively clean. Therefore, the relatively clean part of such quantity of the non-woven fabric is rewound. The relatively clean, used non-woven fabric thus rewound is used once again in the former half of the next cleaning cycle. As described already, in the former half of the cleaning cycle, water and/or the solvent is sprayed to the non-woven fabric so as to dissolve and remove the ink and the like from the blanket cylinder. Therefore, no substantial adverse influence is observed in the finish of the cleaning operation even when somewhat contaminated non-woven fabric is used for the second cleaning cycle.

As described above, about $\frac{1}{3}$ of the used non-woven fabric is rewound and used again in the next cleaning cycle in the present invention. Therefore, that portion of the non-woven fabric for cleaning is used twice. When the non-woven fabric for cleaning is used up, the rewinding mechanism 52 is operated under the state where the cleaning apparatus main body 10 is moved back, and the used non-woven fabric is fully rewound from the take-up roller 28 to the supply roll 26. The used non-woven fabric is removed together with the paper bobbin, discarded and replaced by a new one. Therefore, an operator of the apparatus can replace the non-woven fabric without substantially staining his hands.

In this cleaning apparatus, the press air cylinders 64*a*, 64*b* are returned at the time of take-up and rewinding of the non-woven fabric 30 so that a small gap is defined between the press pad 20 and the blanket cylinder 12. Therefore, the take-up and rewinding operations can be made very easily by extremely small driving force.

In accordance with the present invention, the automatic rewinding mechanism is also disposed on the supply roll side as described above so as to rewind the cleaning cloth from the take-up roller to the supply roll. Therefore, after one cleaning cycle is completed, part of the used cleaning cloth can be rewound to the supply roll and can be used once again during part of the next cleaning cycle. Thus the used quantity of the cleaning cloth can be reduced drastically. Incidentally, if cleaning is made twice or thrice a day and about 40 cm of non-woven fabric is used per cleaning in the case of newspaper printing, for example, it has been necessary conventionally to replace a roll of non-woven fabric which is from about 10 to about 12 m long every 8 to 10 days. In accordance with the present invention wherein about $\frac{1}{3}$, of the used non-woven fabric is, rewound, however, the duration until the replacement is required can be extended to from about 11 to about 15 days. Since this kind of apparatus requires labor saving, lower frequency of replacement is extremely desirable and is more advantageous in that the cost of operation drops accordingly.

Since the used cleaning cloth can be fully rewound to the supply roll after it is used up, replacement with a new cleaning cloth can be made within a short time with hardly any staining.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiment illustrated by the drawings contemplated for carrying out the present embodiments falling within the description of the appended claims.

What is claimed is:

1. A cleaning apparatus of a blanket of a printing press comprising :

a blanket cylinder, a supply roll for supplying a cleaning cloth for cleaning said blanket cylinder, a take-up roller for taking up said cleaning cloth, said take-up roller having an automatic take-up mechanism for automatically taking up said cleaning cloth, press means for pressing said cleaning cloth between said supply roll and said take-up roller to a surface of said blanket cylinder, supporting means for bidirectionally supporting said supply roll and said take-up roller, and automatic rewinding means, coupled to said supply roll, for automatically rewinding said printing cloth from said take-up roller to said supply roll.

2. The cleaning apparatus according to claim 1, wherein said supply roll has a first brake mechanism and said take-up roller has a second brake mechanism, for providing a back tension to each of said supply roll and said take-up roller.

3. The cleaning apparatus according to claim 1, further comprising feed quantity detection means for detecting a feeding quantity of said cleaning cloth, wherein said feed quantity detection means comprises a rotary member rotatably contacting with said cleaning cloth passing through a space between said supply roll and said take-up roller, and a rotation sensor for sensing rotation of said rotary member.

4. The cleaning appartus according to claim 1, wherein said cleaning cloth is a non-woven fabric.

5. A method of cleaning a blanket cylinder of a printing press having a press pad for pressing a cleaning cloth to a surface of said blanket cylinder, comprising the steps of:

subjecting a cleaning cloth to pass through a space between said press pad and said blanket cylinder from a supply roll to a take-up roller, spraying a cleaning liquid to said cleaning cloth, subjecting said press pad to move toward said blanket cylinder to thereby push said cleaning cloth onto a surface of said blanket cylinder, moving slightly back said press pad from said blanket cylinder and winding up said cleaning cloth on said take-up roller, and rewinding a part of said cleaning cloth to said supply roll for a re-use of the part of said cleaning cloth in the following cleaning step.

6. A method of cleaning a blanket cylinder of a printing press comprising the steps: (1) supplying a cleaning cloth; (2) pressing the cleaning cloth to the blanket cylinder; (3) rewinding part of the cleaning cloth; and (4) reusing the rewound part of said cloth.

* * * * *